United States Patent [19]

Keller et al.

[11] 4,328,689

[45] May 11, 1982

[54] SPRING BOLT COMBINATION LOCK

[76] Inventors: Hans Keller, 4437 Chauvin St.; Claude Legault, 4960 Lalande, both of Pierrefonds, Quebec, Canada

[21] Appl. No.: 105,649

[22] Filed: Dec. 20, 1979

[51] Int. Cl.[3] ..... E05B 37/08; E05B 43/00

[52] U.S. Cl. ..... 70/303 A; 70/269; 70/314

[58] Field of Search ..... 70/266, 267, 268, 269, 70/272, 303 A, 303 R, 314, 322, 442

[56] References Cited

U.S. PATENT DOCUMENTS 2,065,867 12/1936 Miller ..... 70/269

2,079,703 5/1937 Diesel ..... 70/269

2,152,258 3/1939 Hirn ..... 70/269

3,481,167 12/1969 Berner ..... 70/314

*Primary Examiner*—Robert L. Wolfe

[57] ABSTRACT

A combination lock having a lock housing with a spring bolt. A manually operable combination dial is provided outside the housing to operate a standard combination mechanism and a bolt retracting cam. A bolt retracting element is secured to the bolt and engageable by the bolt retracting cam when the combination mechanism is operated to a predetermined condition. By turning the dial the retracting cam is operated and the bolt is retracted. A disengagement mechanism disengages the bolt retracting element from the retracting cam, after the dial is released and the bolt is then displaced to its locked position.

9 Claims, 8 Drawing Figures

SPRING BOLT COMBINATION LOCK

BACKGROUND OF THE INVENTION

1. Field of the Invention

The present invention relates to a combination lock having a spring bolt which is retracted by the combination lock and which automatically springs out after release of the combination dial.

2. Description of Prior Art

Of the known type combination locks, these utilize a standard mechanical bolt which is moved to an open position or closed position by the actuation of a bolt displacing mechanism responsive to a manually controllable element located on the outside of a door independent of the combination mechanism. Also, of the combination locks utilizing a combination dial, the combination mechanism remains in an open condition when the door is opened and it is required to scramble the numbers, by spinning the dial, after the door is closed. If a person forgets to scramble the combination, the lock remains unlocked and the door can be opened.

Further, known timing mechanisms usually associated with such combination locks have various disadvantages in that they do not offer any self-locking feature after a set time delay has expired. That is to say, they permit the lock to be opened during the time delay, but after the time delay has expired they do not automatically activate a bolt locking mechanism whereby the bolt will relock automatically and can no longer be retracted from the outside of a door. Also, these type locks of the prior art are very complex and expensive.

SUMMARY OF THE INVENTION

It is a feature of the present invention to provide an improved combination lock which substantially overcomes the above-mentioned disadvantages.

A further feature of the present invention is to provide a combination lock having a spring bolt and a disengagement mechanism which automatically relocks the bolt after the combination dial is released by the operator.

A further feature of the present invention is to provide a combination lock wherein the combination is automatically scrambled as the door is opened and the combination dial released thereby permitting the spring bolt to be retracted only once when the proper combination is set.

A further feature of the present invention is to provide a combination lock having a time delay mechanism which is inaccessible from the outside of a door and which maintains the locking bolt inoperative for a set predetermined period of time and which automatically provides for the bolt to be retracted after the expired time delay.

A further feature of the present invention is to provide a time delay mechanism which is activated from the outside of a door and which permits the spring bolt to be retracted during a precise predetermined period of time only, and automatically prevents the bolt to be retracted after the expiration of that predetermined period of time.

According to the above features, from a broad aspect, the present invention provides a combination lock comprising a lock housing, a spring biased bolt having a locking free end, said bolt being spring biased for sliding movement so that said locking free end moves out of said housing, a manually operable combination element outside said housing for operating a combination mechanism to assume a predetermined condition within said housing, bolt retracting cam means operable from outside said housing; a bolt retracting element secured to said bolt and engageable by said bolt retracting cam means, when said combination mechanism is operated to said predetermined condition, for retracting said locking free end in said housing by displacing and holding said cam means, and disengagement means to disengage said bolt retracting element from said retracting cam means after said locking free end is retracted in said housing to a predetermined position and said cam means is no longer held.

According to a still further broad aspect of the present invention there is provided a combination lock further having a timer mechanism comprising a timer, a time adjustment means disposed on a side of said lock housing opposite the side having said manually operable combination element to set the timer for a predetermined time of operation, a displaceable cam element continuously displaceable by said timer when operative; a lock mechanism disengaging member having an engagement end to hold said bolt retracting element inoperative, and a cam activated end displaceable by said displaceable cam whereby said bolt retracting element is held inoperative for a predetermined time set by said adjustment means.

According to a still further broad aspect of the present invention there is provided a combination lock having a time delay mechanism which comprises a timer mechanism, a time adjustment means disposed on the same side of said lock housing as said manually operable combination element to set the timer for a predetermined time of operation, a displaceable cam element displaceable by said timer when operative; a lock mechanism disengaging member having an engagement end to hold said bolt retracting element inoperative, and a cam activated end displaceable by said displaceable cam whereby said bolt retracting element is held inoperative for a predetermined time set by said adjustment means.

BRIEF DESCRIPTION OF THE DRAWINGS

A preferred embodiment of the present invention will now be described with reference to the examples thereof as illustrated in the accompanying drawings, in which.

DESCRIPTION OF THE PREFERRED EMBODIMENTS

Figure 1:
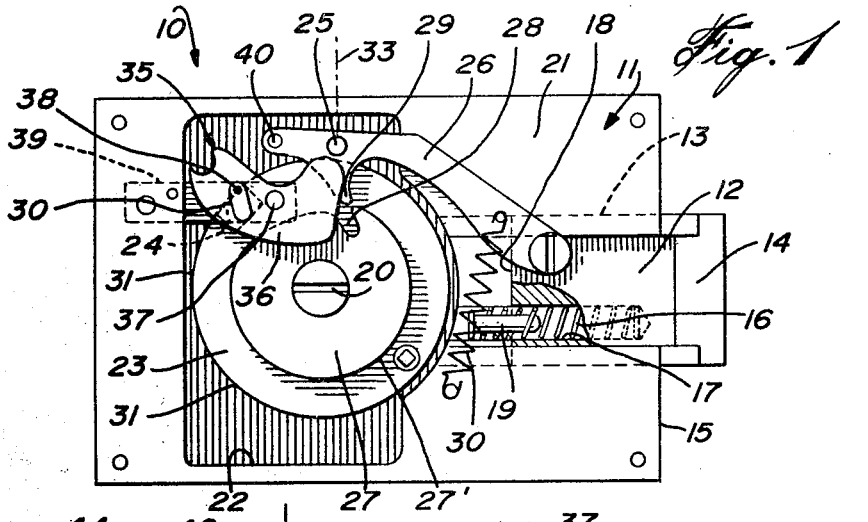
FIG. 1 is a fragmented plan elevation view from the rear of the combination lock.

Referring now to the drawings and more particularly to FIG. 1, there is shown generally at 10 the combination lock of the present invention. The lock comprises a housing 11 having a spring biased bolt 12 secured therein for sliding engagement in a slot 13 formed in the housing 11. The bolt has a locking free end 14 which is displaceable in and out of the end wall 15 of the housing 11. A spring 16 is located in a cavity 17 disposed from the inner end 18 of the bolt 12 and is held stationary by a support 19 whereby to spring bias the bolt 12 to its locked position as shown in FIG. 1.

Figure 2A:
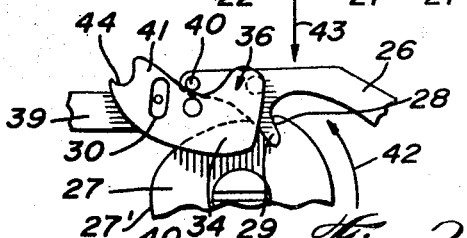
FIGS. 2*a*, 2*b* and 2*c* are fragmented plan views showing the operation of the disengagement mechanism.
Figure 2B:
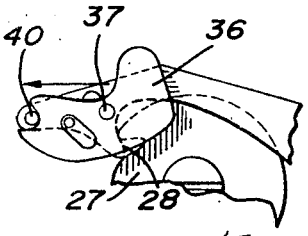
Figure 2C:
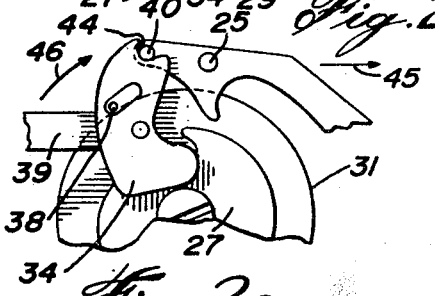
Figure 2E:
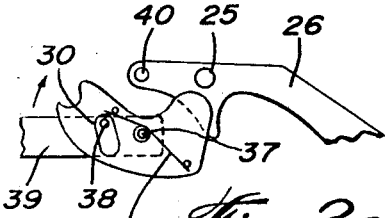
FIG. 2*e* is a fragmented plan view of a further example of the construction of the floating cam.
Figure 2D:
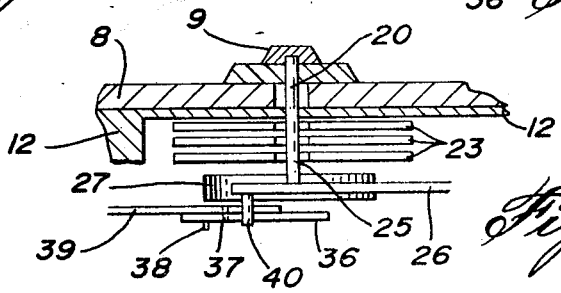
FIG. 2*d* is a top view of the disengagement mechanism and the combination mechanism.

A combination element, such as a combination dial 9, is secured to a shaft 20 and located on the outside of a door 8 to which the housing 11 is secured (see FIG. 2*d*). FIG. 1 shows the rear side 21 of the housing and it is formed with a large cavity 22 to house the combination discs 23 and other mechanisms which will be described later. By rotating the dials 9 of the combination mechanism to its set combination of numbers, the combination discs 23 are aligned with their notches 24 in alignment with one another and immediately below an engageable transverse pin 25 secured to a bolt retracting lever 26.

A bolt retracting cam 27 is also secured to the shaft 20 and is rotated by the dial 9 of the combination mechanism mounted in the front of the door 8. A retracting notch 28 is formed in the periphery 27' of the cam 27 and is dimensioned to receive therein a tooth 29 formed in the lower edge of the bolt retracting lever 26, when the lever 26 moves downwardly by the action of the spring 30 which biases the lever 26 downwardly. As shown in FIG. 1, the lever 26 cannot move downwardly in its present condition as the transverse pin 25 is resting on the outer periphery 31 of the discs 23. However, when the notches 24 are all in alignment the pin 25 is ready to drop into the notches as soon as the tooth 29 becomes aligned with the retracting notch 28 of the cam 27.

A disengagement means 35 coacts with the bolt retracting lever 26 whereby to disengage the lever 26 from the bolt retracting cam 27 and to release the bolt 12 whereby its free end 14 moves out of the end wall 15 by the action of the spring 16. This disengagement means is comprised by a free floating cam 36 which is secured on a pivot 37 and displaceable thereabout in an arcuate path, the length of which is defined by the travel length of the slot 28 formed in the cam 27 with engaged lever 26. A post 38 extends through the slot 30 and is fixed to a fixed arm 39. The pivot pin 37 is also fixed to this arm 39.

Referring now additionally to FIGS. 2*a* to 2*d*, there is shown the operation of the disengagement means and it can be seen that as the tooth 29 of the bolt retracting lever 26 drops into the notch 28 of the bolt retracting cam 27, a follower pin 40 comes in frictional engagement with a follower edge 41 of the floating cam 36. In order to retract the bolt 12, the dial 9 is rotated in a counterclock direction to cause the cam 27 to move in the counterclock direction as indicated by arrow 42. Meanwhile the lever 26 is moved in engagement with the cam 27 by the downward force indicated by arrow 43 provided on the lever 26 by the spring 30. As the cam is rotated in the direction of arrow 42, the follower pin 40 moves along the follower edge 41 to locate itself in a support notch 44 provided at a free end of the cam 36. With the dial held in this position the bolt 12 is completely retracted in the housing 11 and the door 8 to which the housing is secured can then be opened. Thus, the mechanism is in its condition as shown in FIG. 2*b*. It can also be seen that when the cam 27 was rotated, the transverse pin 25 on the lever 26 displaced the combination disc 23 in a counterclock direction and moved the notches 24 out of alignment with the lock opening axis 33 (see FIG. 1). Thereby, the combination which was preset to open the lock has been displaced or scrambled automatically by retracting the bolt 12.

Referring now to FIG. 2*c* there is shown the action of the mechanism as soon as the combination dial is released by the operator. When the dial 9 is released the bolt retracting lever 26 will move forwardly along the direction of arrow 45 by the action of the spring 16 acting on the bolt 12. This will cause the free floating cam 36 to pivot upwardly along the direction of arrow 46 and move the engagement transverse pin 25 out of the notches 24, and at the same time disengage the tooth 29 from the retracting notch 28 and free the follower pin 40 from its engagement with the cam 36. The bolt 12 thus moves to its fully extended position as shown in FIG. 1 and the engageable transverse pin 25 rests on the periphery 27' or the combination disc 23. The follower pin 40 disengages from the notch 44 and the cam 36 returns to its position shown in FIG. 1. Once the door is closed, the bolt will move into the housing due to the external force applied on its free end 14 by the door frame (not shown) holding the door 8 and as soon as the bolt is in alignment with its locking cavity in the frame (not shown) it will again extend out of the housing into the locking cavity and lock the door. Since the combination has been automatically scrambled the door can no longer be opened and it is not necessary to manually spin the dial outside the housing to ensure that the door is locked.

As shown in FIG. 2*c*, the floating cam 36 has a counterweight portion 34 which biases the support notch 44 upwardly. FIG. 2*e* shows the cam 36 biased by means of a spring 36' secured about pivot pin 37, biasing the notch 44 upwardly with pin 38 at the bottom of slot 30.

Figure 3:
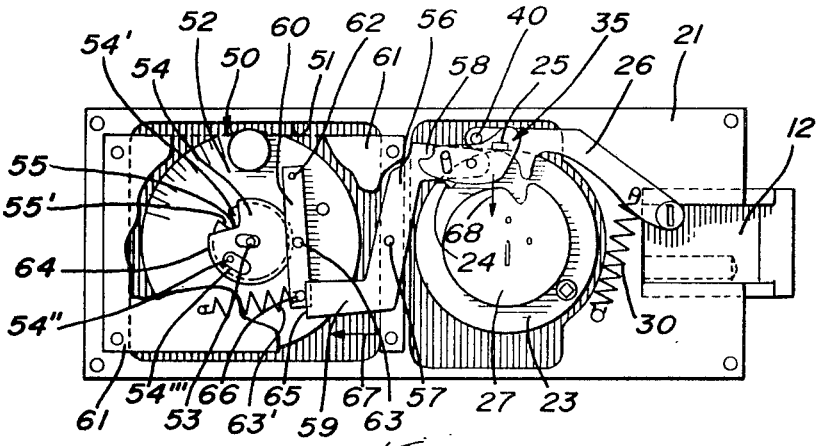
FIG. 3 is a fragmented plan elevation view showing a combination time lock associated therewith.

Referring now to FIG. 3, there is shown the combination lock modified to incorporate therewith a time lock mechanism 50. The time lock mechanism 50 is mounted on the backside 21 of the housing 11. In this embodiment the housing 11 is made longer and has a further large cavity 51 to accommodate the timer mechanism 50. The mechanism 50 comprises a timer (not shown) located behind the time adjustment dial 52. The time adjustment dial 52 is mounted on a shaft 53 which winds the timer and which has a timer cam assembly comprising cams 54 and 54' mounted on the shaft. Both cams 54 and 54' are circular and have notches 55 and 55' in their respective periphery and are displaced by rotation of the shaft 53. Their notches are also displaced to one another an amount determined by the length of slot 54''' in which rim 54'' travels and sufficient to permit the follower pin 63 to instantly drop into the cavity 55' and 55. Cavity 55 is to lift the follower pin out of cavity 55' by turning the cam 54.

A lock mechanism disengaging member 56 is associated with both the combination lock mechanism and the timer mechanism 50. The disengaging member 56 is a Z-shaped arm pivotally secured on a pivot pin 57 and rockable in both directions thereabout. The disengaging member 56 is provided with an engagement end 58 to hold the lever 26 inoperable when the timer mechanism 50 is operative. The member 56 also has a cam activated end 59 which is displaceable by a rocking lever 60. The locking lever is secured to a wall 61 at a top end by a pivot pin 62 and it is provided with a follower pin 63 along its length which pin is biased against the outer periphery 64 of the cam 54 by means of spring 63'. The free end 65 of the cam activated end 59 of the lever 56 is biased against a stop pin 66 secured to the rock lever 60.

As the timer mechanism operates, the cam 54 rotates and as soon as the notch 55 aligns itself with the follower pin 63, the cam activated end 59 of the displaceable lever 56 will start moving in the direction of arrow 67 causing the engaging end 58 to move downwardly in the direction of arrow 68. The engaging end 58 will move down to a predetermined position dependent on the depth of the notch 55 and this position is substantially the same position as the fixed arm 39 assumed with the combination lock mechanism shown in FIG. 1. The engaging end 58 of the displaceable member 56 now acts as the fixed arm 39 shown in FIG. 1 as it now supports the disengagement means which includes the free floating cam 36. The combination lock is now in a position to be opened.

As previously stated, this timer mechanism 50 is mounted on the backside of the housing and it is provided to disengage the combination lock mechanism for a set period of time. It can be seen that by setting the time adjustment dial to a predetermined time, the engaging end 58 of the displaceable member 56 holds the lever 26 in a disengaged position and the lock cannot be opened from the outside by the combination dials until the set time on the timer mechanism 50 has expired.

Figure 4:
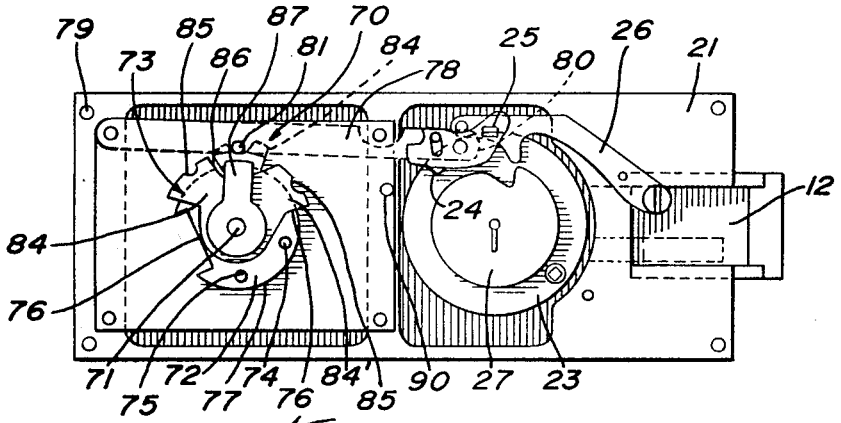
FIG. 4 is a fragmented plan elevation view of the time lock showing a short time delay lock mechanism associated therewith.

Referring now to FIG. 4, there is shown a further time delay mechanism 70 and it is operated from the outside of the door 9 to which the lock housing 11 is secured to. This is a short time delay mechanism and it consists of a timer (not shown) which is wound by a key lock 87 or other suitable rotatable means (not shown) mounted on the front side of the door and secured to a shaft 71. A displaceable cam element 72 is secured to the shaft 71 and is continuously displaceable by the timer as the preset time advances. The cam element 72 is provided with a large cavity 76 in the periphery 77 thereof. A lock mechanism disengaging link arm 78 is associated with the cam 72 and is caused to pivot on a pivot end 79 whereby the free engagement end 80 thereof will disengage the lever 26, in the same manner as engagement end 58 of the displaceable member 56 described above with respect to FIG. 3. With the engagement end 80 biased upwardly, as shown in FIG. 4, the lever 26 is disengaged and the bolt cannot be retracted. However, the combination dial can be set to its predetermined combination numbers whereby to line up the notches 24 of the discs 23 on the proper axis to cause the engagement of the lever 26. The link arm 78 is provided with a follower pin 81 which is caused to rest on the periphery 77 of the cam 72.

As previously mentioned, the timer mechanism 70 is a short time delay timer and when it is set, the link arm 78 drops down slightly with the follower pin 81 resting on the periphery 77 of the cam. As the timer operates the cam 72 rotates until the large cavity 76 aligns itself with the follower pin 81. The pin 81 thus drops into the cavity 76 and positions the lever 26 for engagement by the bolt retracting cam 27. Thus, the bolt 12 can be retracted as previously described.

The timer continues to operate for a predetermined short period of time and the cam 72 continues to rotate. In this second period of time, known as open cycle, the timer continuously rotates and pin 75 will push the cam 73 to move the pin 81 outwardly and the link arm moves up to displace the lever 26 in a disengaged position as shown in FIG 4. This upward movement of the link arm 78 is effected by the relocking cam 73 which is movably secured about the shaft 71 and which is displaceable by cam pin 74 or 75 (74 to set and 75 to relock) acting on the engaging edge 86 and 76, respectively, of the relocking cam 73. The relocking cam causes the follower pin 81 to move out of the large cavity 76 and be displaced on the engaging edge 86 until the pin 81 moves into a support slot 84 on a top edge of arm 84 of the cam 73. If the combination lock is not opened whilst the follower pin 81 is in the large cavity 76, it will automatically relock by pushing pin 75 by the clockwise motion of the timer on edge 86 until the timer comes to a full stop. The position of cam 84 is as shown with pin 81 locked into cavity 85. It is then necessary to rewind the short time delay mechanism to start the time sequence again. Support arm 84' is provided to have left and right hand wound movements and the pins 74 and 75 would be on the other side of slot 76.

It can be seen that both the mechanisms of FIGS. 3 and 4 provide different locks. It is only necessary to extend the follower pin 40 of the lever 26 and to mount the free floating cam 36 on the engaging end 58 of the displaceable member 56 of the timer of FIG. 3. The link arm 78 would be provided to replace arm 56 and engage an extended end portion of the follower pin 40. Of course, the timer mechanisms being different would be reverse mounted.

It is within the ambit of the present invention to provide any obvious modifications of the examples described hereinabove provided such modifications fall within the broad scope of the appended claims. For example, various electrical contacts, such as 90 in FIG. 4, may be provided to indicate the condition of the locks, that is to say, an open condition of the lock, the condition of the lever 26, etc., whatever is necessary.

I claim:

1. A combination lock comprising a lock housing, a spring biased bolt having a locking free end, said bolt being spring biased for sliding movement so that said locking free end moves out of said housing, a manually operable combination element outside said housing for operating a combination mechanism to assume a predetermined condition within said housing, bolt retracting cam means operable from outside said housing; a bolt retracting element secured to said bolt and engageable by said bolt retracting cam means, when said combination mechanism is operated to said predetermined condition, for retracting said locking free end in said housing by displacing and holding said cam means, disengagement means to disengage said bolt retracting element from said retracting cam means after said locking free end is retracted in said housing to a predetermined position and said cam means is no longer held, a timer mechanism having a time adjustment means disposed on a side of said lock housing opposite the side having said manually operable combination element to set the timer for a predetermined time of operation, a displaceable cam element continuously displaceable by said timer when operative; a lock mechanism disengaging member having an engagement end to hold said bolt retracting element inoperative, a cam activated end displaceable by said displaceable cam whereby said bolt retracting element is held inoperative for a predetermined time set by said adjustment means, said disengaging means being a pivoted link arm, and a cam follower element in displaceable engagement with said cam element and engaging said cam activated end.

2. A combination lock as claimed in claim 1 wherein said cam means is operable by manual displacement of said combination element, said bolt being disengaged by releasing said combination element.

3. A combination lock as claimed in claim 2 wherein said combination mechanism comprises at least one rotatable disc engageable by a shaft rotatable by said combination element and having a peripheral slot, said bolt retracting element having a guide element biased against said rotatable disc and displaceable in said slot when in alignment therewith, said bolt retracting cam means being a retracting disc secured to said shaft.

4. A combination lock as claimed in claim 3 wherein said retracting disc has a peripheral engaging slot to receive a finger member of said bolt retracting element when said guide element is aligned with said slot in said rotatable disc, said retracting disc displacing said combination mechanism from said predetermined condition when said bolt is retracted.

5. A combination lock as claimed in claim 2 wherein said disengagement means is a displaceable element having a releasable engagement means to engage said bolt retracting element to displace it from engagement with said bolt retracting cam means and said combination mechanism and to release said bolt retracting element from said engagement means upon said release of said combination element.

6. A combination lock as claimed in claim 5 wherein said displaceable element is a pivoted arm, said arm being secured to a pivot, restricting means to limit the displacement of said arm about said pivot, said engagement means being an engagement notch in said arm.

7. A combination lock as claimed in claim 6 wherein said arm is pivoted to release said bolt retracting element by the spring force of the locking bolt acting thereon by the correction through the bolt retracting element.

8. A combination lock as claimed in claim 1 wherein said engagement end is a support edge of said link arm in support engagement under a follower pin secured to said bolt retracting element to displace said retracting element free from engagement by said bolt retracting cam means when said follower element is displaced to a first position by said cam element, said support edge being retracted when said follower element is displaced to a second position after said set predetermined time has expired.

9. A combination lock as claimed in claim 8 wherein said disengagement means is secured to said lock mechanism disengaging member and disengages said bolt retracting element from said retracting cam means after said follower element is displaced to said second position.

* * * * *